US007439924B2

(12) United States Patent
Schantz

(10) Patent No.: US 7,439,924 B2
(45) Date of Patent: Oct. 21, 2008

(54) OFFSET OVERLAPPING SLOT LINE ANTENNA APPARATUS

(75) Inventor: Hans Gregory Schantz, Huntsville, AL (US)

(73) Assignee: Next-RF, Inc., Brownsboro, AL (US)

( * ) Notice: Subject to any disclaimer, the term of this patent is extended or adjusted under 35 U.S.C. 154(b) by 0 days.

(21) Appl. No.: 11/455,425

(22) Filed: Jun. 19, 2006

(65) Prior Publication Data

US 2006/0244674 A1 Nov. 2, 2006

Related U.S. Application Data

(63) Continuation-in-part of application No. 10/965,921, filed on Oct. 15, 2004, now Pat. No. 7,064,723.

(60) Provisional application No. 60/512,872, filed on Oct. 20, 2003.

(51) Int. Cl.
*H01Q 13/10* (2006.01)

(52) U.S. Cl. ..... 343/768; 343/770; 343/795

(58) Field of Classification Search ..... 343/768, 343/700 MS, 702, 767, 769, 770, 794, 795
See application file for complete search history.

(56) References Cited

U.S. PATENT DOCUMENTS 6,529,170 B1 * 3/2003 Nishizawa et al. ..... 343/795
6,593,895 B2 * 7/2003 Nesic et al. ..... 343/795

* cited by examiner

*Primary Examiner*—Trinh V. Dinh
*Assistant Examiner*—Dieu Hien T Duong

(57) ABSTRACT

An offset overlapping slot line comprises a first metallization on a first side of a dielectric substrate and a second metallization on a second side of a dielectric substrate cooperating to yield a transmission line. By overlapping the first and second metallizations, one may achieve much lower impedance than in traditional slot line transmission line structures. An offset overlapping slot line antenna apparatus incorporates an offset overlapping slot line in a feed region. This has the benefit of yielding a low input impedance. A low input impedance allows a transmit antenna to bed driven efficiently even by low voltage, high current drivers. Also a low input impedance can help reduce thermal noise in a received front-end. This technique is well suited for application to dipole, monopole, slot, and annular slot antennas, to name a few examples.

20 Claims, 8 Drawing Sheets

400

700

800

900

1000

1300

1400

1500

1600

OFFSET OVERLAPPING SLOT LINE ANTENNA APPARATUS

The present application is a continuation-in-part of a U.S. patent application titled: "Spectral control antenna apparatus and method," filed Oct. 15, 2004, Ser. No. 10/965,921, published as Pub. No. U.S. 2005/0151693 A1 by Schantz. This application further claims benefit under 35 USC 119(e) of prior filed co-pending Provisional Patent Application Ser. No. 60/512,872 filed Oct. 20, 2003.

BACKGROUND OF THE INVENTION

1. Field of the Invention

The present invention relates to antennas and more specifically to planar broadband antennas incorporating an overlapping offset slot line.

2. Description of the Prior Art

Practitioners of the antenna arts have long realized that a tapered antenna feed leads to an improved broadband match. Early examples of such antennas include those of Carter [U.S. Pat. No. 2,181,870], and Brillouin [U.S. Pat. No. 2,454,766]. These concepts have been applied to planar antennas as well, notably by Nester [U.S. Pat. No. 4,500,887] who taught a tapered microstrip horn. Antenna radiating elements have been similarly tapered. For instance, Barnes [U.S. Pat. Nos. 6,091,374; 6,400,329 and 6,621,462] disclosed a tapered slot antenna and the inventor disclosed a semi-coaxial horn with a tapered horn element [U.S. Pat. No. 6,538,615].

In some cases, a tapered feed and tapered radiating element have been combined in the same antenna structure. For example, Lindenblad [U.S. Pat. No. 2,239,724], invented a wideband antenna with a tapered feed connected to a tapered bulbous radiating element. More recently the inventor implemented a planar antenna with a tapered feed structure smoothly flowing into elliptically tapered planar dipole elements [U.S. Pat. Nos. 6,512,488 and 6,642,903].

This prior art is characterized by generally monotonic variations in impedance with distance along a signal path traversing an antenna feed structure, radiating elements, and surrounding medium or space. These monotonic variations in impedance are generally considered desirable because they help to optimize a broad band match between an antenna and a transmission line. These monotonic variations may be discontinuous (as in a Klopfenstein taper) or have points of inflection (as in an Exponential taper).

Wavy shaped or corrugated antenna structures have been adopted for diffraction control or to increase impedance [Kraus, *Antennas* $2^{nd}$ ed., New York: McGraw-Hill, pp. 657-9]. McCorkle [U.S. Pat. No. 6,590,545] discloses (FIG. 21) a planar UWB antenna with a wavy shaped slot. McCorkle suggests that a band stop transfer function might be possible by adjusting the width of the tapered clearance, however neither the drawings nor the detailed description provide any guidance to one skilled in the art as to how such adjustment gives rise to band stop behavior. In practice, the small periodic variations in tapered clearance shown by McCorkle are largely ineffective in giving rise to significant manipulation of an antenna transfer function, particularly since the disclosed variations maintain a continuous increase in width.

The inventor [U.S. Pat. No. 6,774,859] discovered that a practical means for implementing band stop or frequency notch filters in an otherwise ultra-wideband antenna is to incorporate a discrete narrow band resonant structure.

An alternate filtering technique, stepped impedance low pass filtering is also known in the art [David M. Pozar, *Microwave Engineering,* $2^{nd}$ ed., New York: John Wiley & Sons, 1998, pp. 470-473]. This technique has not been applied to control impedance of antennas and implement desired transfer functions in antennas, however.

The extreme bandwidths of ultra-wideband antennas leave them especially vulnerable to interferers. It is a challenge to design an RF-front end to provide sufficient rejection to adjacent interferers just above an antennas operating band without adversely impacting performance in a desired band. For instance, it is desirable to have an ultra-wideband antenna responsive to the 3.1-5.0 GHz band without being responsive to interferers operating above 5.0 GHz. An electrically small UWB antenna is naturally unresponsive to signals lying below its operational band. Making such an antenna unresponsive to higher frequency signals is a greater challenge.

In view of the foregoing, there is a need for a system and method of modifying an antenna slot or notch to create the large variations in impedance necessary to implement effective distributed filters. There is a further need for a method to implement filtering or a desired transfer function with minimal modifications to an existing antenna design. Additionally, there is a need for an antenna apparatus that implements filtering capability inexpensively without requiring the added expense and board space of a lumped element filter structure in the RF front end of a radio device.

SUMMARY OF THE INVENTION

Accordingly, it is an object of the present invention to provide a means for modifying an antenna slot or notch to create large variation in impedance necessary to implement effect distributed filters. It is a further object of the present invention to provide a desired transfer response to an otherwise broad band antenna. Yet another object of the present invention is to implement filtering capability inexpensively without requiring the added expense and board space of a lumped element filter structure in the RF front end of a radio device.

These objects and more are met by the present invention: a spectral control antenna apparatus including a feed region or feed gap and a surrounding space or medium. A signal path between a feed region and a surrounding space or medium is characterized by a length dependent impedance with a plurality of extrema whereby the antenna apparatus exhibits a desired spectral response. The invention is well-suited for application to planar antennas, particularly planar antennas characterized by a slot type transmission line structure. If such a transmission line structure is an offset slot line, then by overlapping sections of the offset slot line relatively low impedances are possible, thus enabling the large variations in impedance necessary for effective filtering behavior.

An antenna spectral control system includes an RF device, a feed region, a surrounding space or medium, and a signal path between the feed region and the surrounding space. The present invention teaches using a variation in characteristic impedance along the length of a signal path to give rise to a desired spectral response. Means for varying impedance may include dielectric loading, transmission line geometry variation, or other means for varying impedance. A particularly effective way of varying impedance involves using an offset slot line transmission line structure with overlapping sections. In alternate embodiments, discrete lumped capacitances or inductances may be distributed along a signal path for added spectral control.

In alternate embodiments, a spectral control antenna apparatus comprises a dielectric substrate, a first conducting layer, and a second conducting layer. A first conducting layer and a second conducting layer cooperate to form a slot line transmission line structure including a plurality of extrema. A first conducting layer and a second conducting layer may be coplanar on the same side of a dielectric substrate, or may lie on opposite sides of a dielectric substrate. In still further embodiments, a slot line transmission line structure includes a plurality of overlapping sections.

Further, a method for spectral control of an antenna comprises providing a signal path between a feed region and a surrounding space or medium having a characteristic impedance with dependence on a length of a signal path; and providing a means for varying impedance whereby an antenna exhibits a desired spectral response. A means for varying impedance may include using lumped elements, dielectric loading, or geometry variations.

With these and other objects, advantages, and features of the invention that may become hereinafter apparent, the nature of the invention may be more clearly understood by reference to the detailed description of the invention, the appended claims and to the several drawings herein.

DETAILED DESCRIPTION OF THE PREFERRED EMBODIMENT

Overview of the Invention

The present invention is directed to an offset overlapping slot line antenna apparatus. The present invention teaches a novel class of broadband antennas that achieve low impedance (typically less than 50 ohm) by incorporating an offset overlapping slot line in a feed region.

The present invention will now be described more fully in detail with reference to the accompanying drawings, in which the preferred embodiments of the invention are shown. This invention should not, however, be construed as limited to the embodiments set forth herein; rather, they are provided so that this application will be thorough and complete and will fully convey the scope of the invention to those skilled in the art. Like numbers refer to like elements throughout.

Transmission Line Structures

Figure 1:
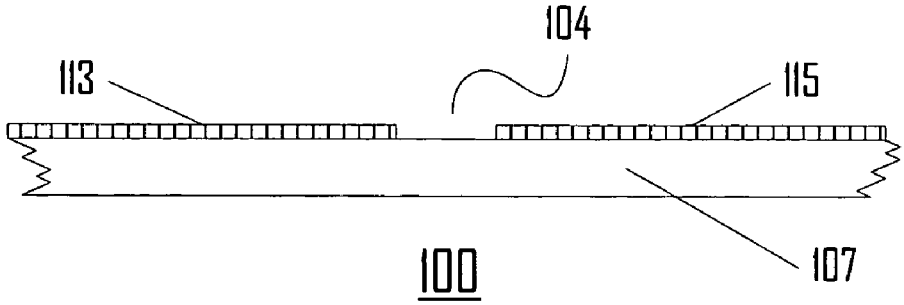
FIG. 1 is a cross-section of a same-side slot line.

FIG. 1 is a cross-section 100 of a same-side antenna slot 104. Same-side slot line 104 comprises a first conducting layer 113, a second conducting layer 115, and a dielectric substrate 107. A first conducting layer 113 and a second conducting layer 115 cooperate to form a transmission line structure constraining fields to a particular signal path.

Figure 2:
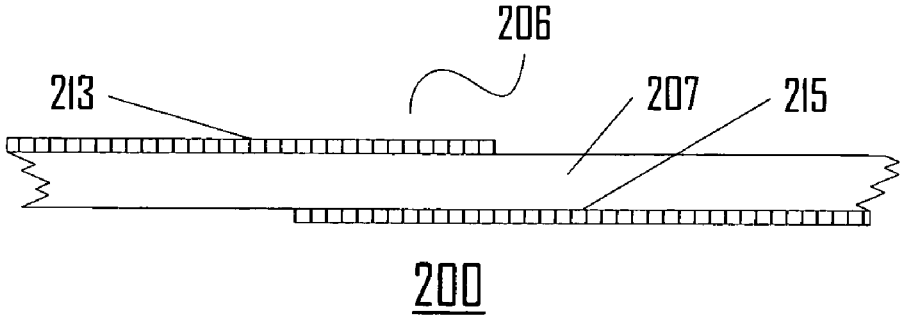
FIG. 2 is a cross-section of an overlapping offset slot line.

FIG. 2 is a cross-section 200 of an overlapping offset slot line 206. Overlapping offset slot line 206 comprises a first conducting layer 213, a second conducting layer 215, and a dielectric substrate 207. A first conducting layer 213 and a second conducting layer 215 cooperate to form a transmission line structure constraining fields to a particular signal path. Overlapping offset slot line 206 has a low impedance and is electrically equivalent to a shunt capacitance.

Figure 3:
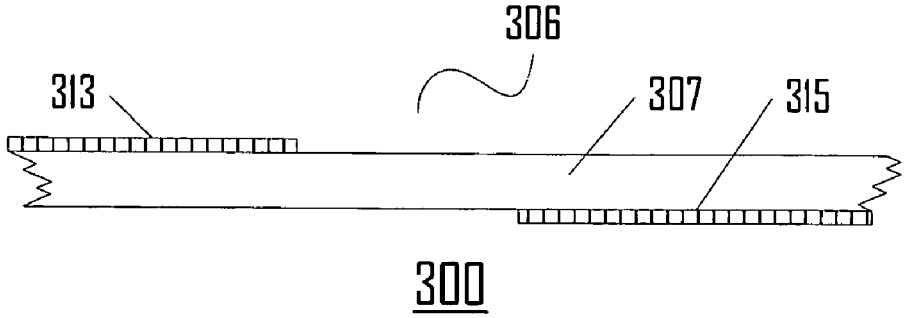
FIG. 3 is a cross-section of a wide offset slot line.

FIG. 3 is a cross-section 300 of a wide offset slot line 306. Wide offset slot line 306 comprises a first conducting layer 313, a second conducting layer 315, and a dielectric substrate 307. A first conducting layer 313 and a second conducting layer 315 cooperate to form a transmission line structure constraining fields to a particular signal path. Wide offset slot line 306 has a high impedance and is electrically equivalent to a series inductance.

With shunt capacitance and series inductance, implementation of a low pass filtering response is straightforward. In alternate embodiments, however, other transfer functions like a band stop or even a high pass might be introduced, but at the cost of a larger or more complicated structure than a corresponding low pass filter.

Preferred Embodiment

Figure 4:
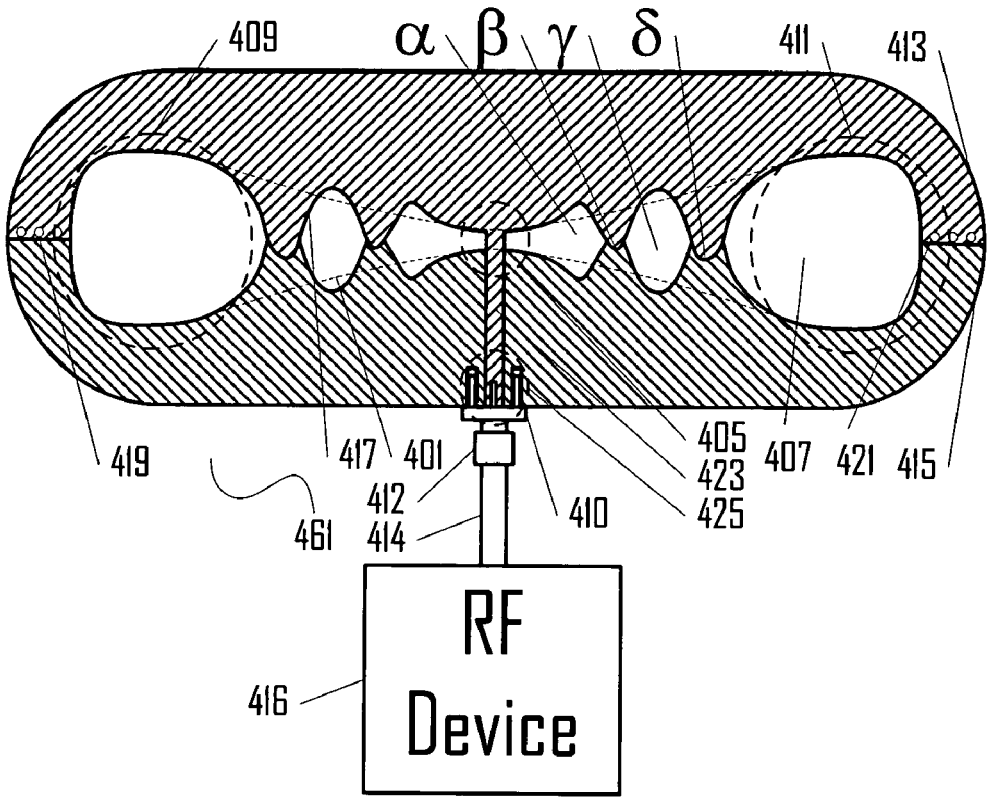
FIG. 4 is a schematic diagram depicting a preferred embodiment spectral control UWB magnetic slot antenna according to the teachings of the present invention.

FIG. 4 is a schematic diagram 400 depicting a preferred embodiment spectral control magnetic slot antenna 461 according to the teachings of the present invention. A first conducting surface 413 on a front side of a dielectric substrate 407 and a second conducting surface 415 on a back side of a dielectric substrate 407 cooperate to form complex tapered slot 417. Complex taper slot 417 is an example of an offset slot line, in which conducting surfaces (like first conducting surface 413 and second conducting surface 415) on opposing sides of a dielectric (like dielectric substrate 407) cooperate to form a transmission line structure defining a signal path. A plurality of first vias 419 and a plurality of second vias 421 electrically couple first conducting surface 413 to second conducting surface 415 in the vicinity of first open termination 409 and second open termination 411, respectively. In alternate embodiments, first conducting surface 413 may be electrically coupled using capacitive coupling to second conducting surface 415 by overlapping first conducting surface 413 and second conducting surface 415. Preferred embodiment 461 is a closed slot antenna, since complex taper slot 417 is a closed slot (i.e. a closed slot transmission line structure). A closed slot is a slot formed by two conductors (like first conducting surface 413 and second conducting surface 415) coupled not only at a feed region but also at a termination region (like first open termination 409 and second open termination 411).

Complex tapered slot 417 does not vary monotonically from a narrow (low impedance) section in the vicinity of feed gap 405 to a wide (high impedance) first open termination 409 and a wide (high impedance) second open termination 411. Instead, complex tapered slot 417 differs from conventional prior art slot 401. Complex tapered slot 417 becomes wider at a first extremum (denoted "α") resulting in a relatively high impedance. Complex tapered slot 417 becomes narrower and overlaps at a second extremum (denoted "β"), resulting in a relatively low impedance. Complex tapered slot 417 becomes wider at a third extremum (denoted "γ"), resulting in a relatively high impedance. Complex tapered slot 417 becomes narrower and overlaps at a fourth extremum (denoted "δ"), resulting in a relatively low impedance. A narrow or preferentially overlapping section forms a low impedance offset slot (like extrema β and extrema δ) with behavior analogous to a shunt capacitance. Thus extrema β and extrema δ have associated cross sections similar to that of overlapping offset slot line 206. A wide, high impedance slot (like extrema α and extrema γ) is analogous to a series inductance. Thus extrema α and extrema γ have associated cross sections similar to that of wide offset slot line 308. A large variation in impedance helps maximize filtering performance in a minimal length. An offset slot line with the ability to include low impedance overlapping sections can support a larger variation in impedance than a corresponding same side slotline. Thus, it is advantageous (although not required) to employ an offset slot line in a spectral control antenna.

Figure 5:
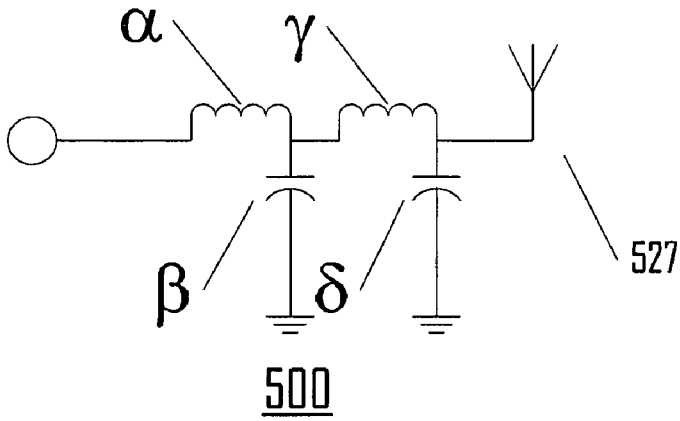
FIG. 5 is a circuit diagram showing an equivalent circuit for a preferred embodiment spectral control magnetic slot antenna.

FIG. 5 shows equivalent circuit 500 for complex tapered slot 417. Equivalent circuit 500 behaves like a low pass filter coupled to an antenna 527 or means for transmitting and/or receiving electromagnetic signals. Additional inductance and capacitance may be incorporated in an antenna design using discrete components distributed along complex taper slot 417.

The methods disclosed by the present invention are best suited for creating a low pass filter behavior, however it is also possible to implement other transfer responses in antennas using the teachings of the present invention. Also, although the teachings of the present invention are well suited for application to ultra-wideband antennas, the present invention also has application to broad band or narrow band antennas.

Complex taper slot 417 constrains signals to particular signal paths. On a second side of complex tapered slot 417, radiated signals traverse a signal path from feed gap 405 to second open termination 411 and thence to a surrounding medium or free space intermediate first extremum α, second extremum β, third extremum γ, and fourth extremum δ. On a first side of complex tapered slot 417, radiated signals traverse a signal path from feed gap 405 to first open termination 409 intermediate similar extrema. An antenna comprises at least one signal path defined by the geometry of the antenna. In many cases an antenna may have more than one signal path, depending on the geometry.

For ease of explanation a signal path is described in terms of radiating a signal. A received signal follows an analogous but reversed path. The principles of the present invention apply to both the reception and transmission or radiation of electromagnetic signals. For ease of explanation this application will focus primarily on radiation of signals with the proviso that it is understood that reception of signals is also inherently described.

In preferred embodiment 461, complex tapered slot 417 has four extrema: α, β, γ, δ. In alternate embodiments, complex tapered slot 417 may have more or fewer extrema. Also, complex tapered slot 417 is shown as a symmetric slot with similar taper from feed gap 405 to a wide (high impedance) first open termination 409 and from feed gap 405 to a wide (high impedance) second open termination 411. In alternate embodiments complex tapered slot 417 may be asymmetric.

Preferred embodiment 461 comprises complex tapered slot 417 fed across feed gap 401. In some embodiments feed gap 401 couples to a feed line 423. Feed line 423 couples to a connector interface 425. In still further embodiments, feed line 423 may couple to an RF device 416 via end launcher 410, connector 412, and coaxial line 414. In alternate embodiments, RF device 416 may be located on dielectric substrate 407 and directly coupled to complex taper slot 417 via feed line 423.

Preferred embodiment 461 is a planar antenna system. Planar antennas are advantageous because they tend to be easy and inexpensive to manufacture. If implemented on a flexible or curved substrate, planar antennas may assume a variety of useful form factors.

Figure 6:
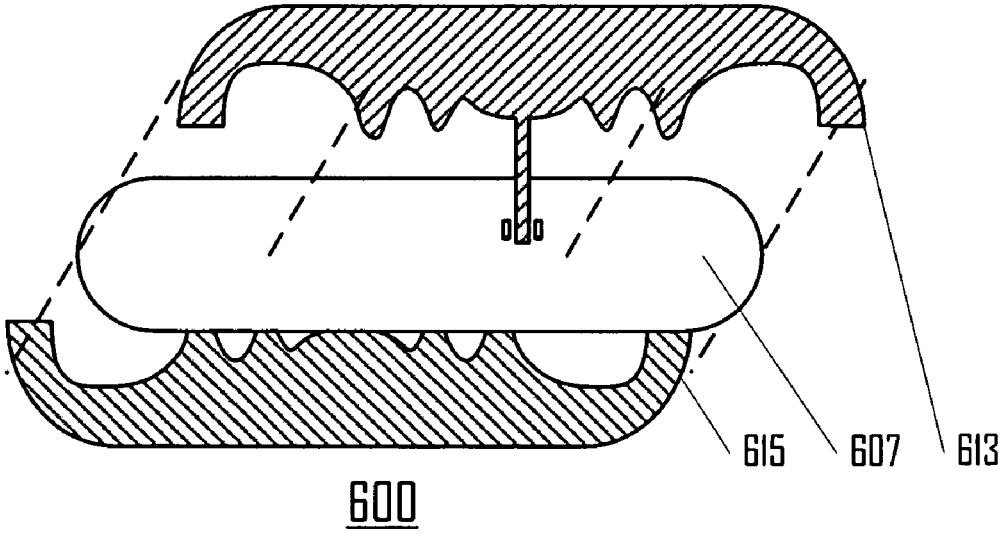
FIG. 6 is an exploded view of a preferred embodiment spectral control magnetic slot antenna.

FIG. 6 is an exploded view 600 of preferred embodiment spectral control magnetic slot antenna 461. Exploded view 600 shows top conducting layer 613, dielectric substrate 607, and bottom conducting layer 615. Terms like "front" and "back" or "top" and "bottom" are used throughout this application to aid the reader in visualizing a particular illustration of an embodiment of the invention and should not be interpreted as limiting or requiring any particular physical orientation or arrangement.

Detailed Analysis of a Potential Implementation

Figure 7:
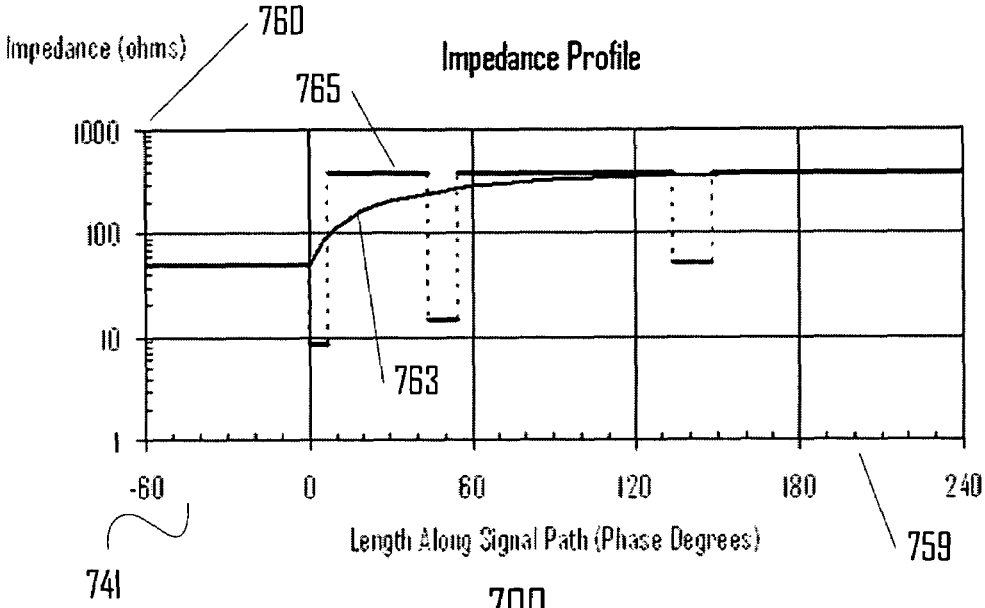
FIG. 7 is a plot of an impedance profile of a potential implementation.

FIG. 7 is a plot 700 of an impedance profile 741 of a potential implementation. Length along a signal path is plotted on horizontal axis 759 and impedance is plotted along vertical axis 760. Exponential impedance trace 763 is typical of a prior art monotonically increasing impedance taper. Complex impedance trace 765 is typical of impedance responses taught by the present invention.

Note that large variations in impedance are essential to implement a significant filter response in a minimal length signal path. In the potential implementation of impedance profile 741, the electrical length is 148 degrees measured at 5900 MHz. This is less than a quarter wavelength at 3000 MHz. Impedance variations are over more than a factor of 10 from 9 to 377 ohms. Thus, means for implementing significant variations in impedance are essential for a successful implementation. The table below provides details of this potential implementation by showing the electrical length in phase degrees of a particular impedance section in ohms.

| Phase Angle (deg) | Z(ohms) |
|---|---|
| 6.9 | 8.62 |
| 36.8 | 377 |
| 11.4 | 14.8 |
| 78.8 | 377 |
| 14.1 | 52.4 |

Figure 8:
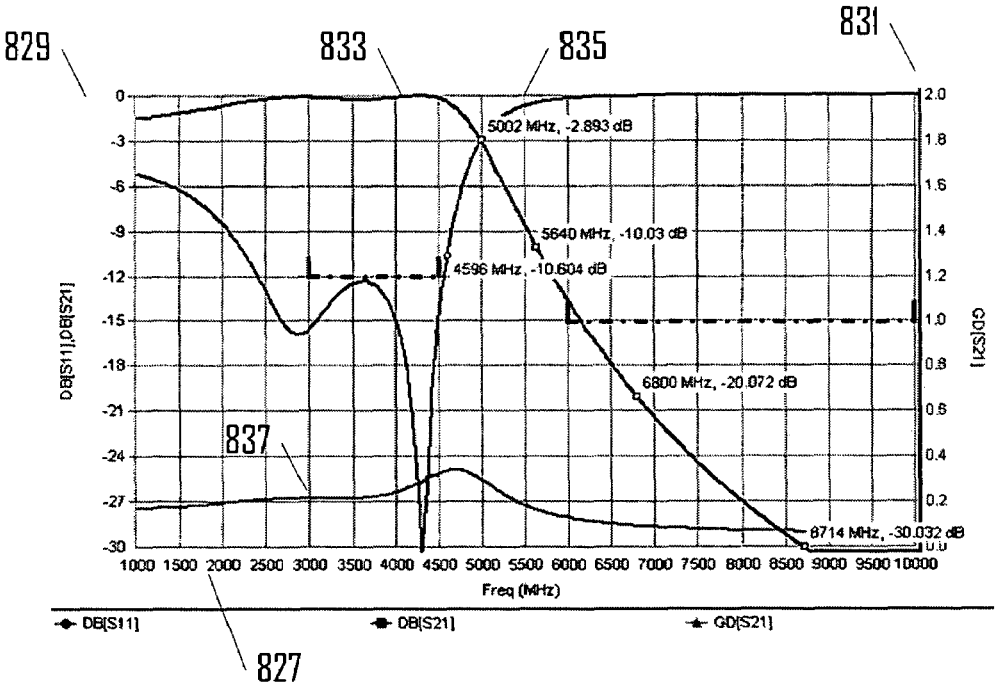
FIG. 8 is a plot of a spectral response of a potential implementation.

FIG. 8 is a plot of a spectral response 800 corresponding to impedance profile 741 of a potential implementation. Spectral response plot 800 depicts frequency in MHZ on horizontal axis 827; scattering parameter magnitude in dB on primary vertical axis 829; and group delay in nanoseconds on secondary vertical axis 831. Spectral response plot 800 shows return loss ($S_{11}$) response 835, through ($S_{21}$) response 833, and group delay response 837.

Return loss ($S_{11}$) response 835, is comfortably −12 dB or below between 2500 MHZ and 4500 MHz, rising to −3 dB at about 5000 MHz. Through ($S_{21}$) response 733 shows negligible loss between 2500 MHZ and 4500 MHz, falling off smoothly to −3 dB around 5000 MHz. Group delay response 837 shows only a modest increase around 4800 MHz. Thus, spectral response 800 is not dispersive and is thus well-suited for an antenna. Although many possible numeric and analytic techniques may be applied to develop an impedance taper corresponding to a desired transfer function (or filter response), the inventor has found that readily available analysis software such as Eagleware is an easy and quick way to accomplish this task.

Alternate Embodiments

Figure 9:
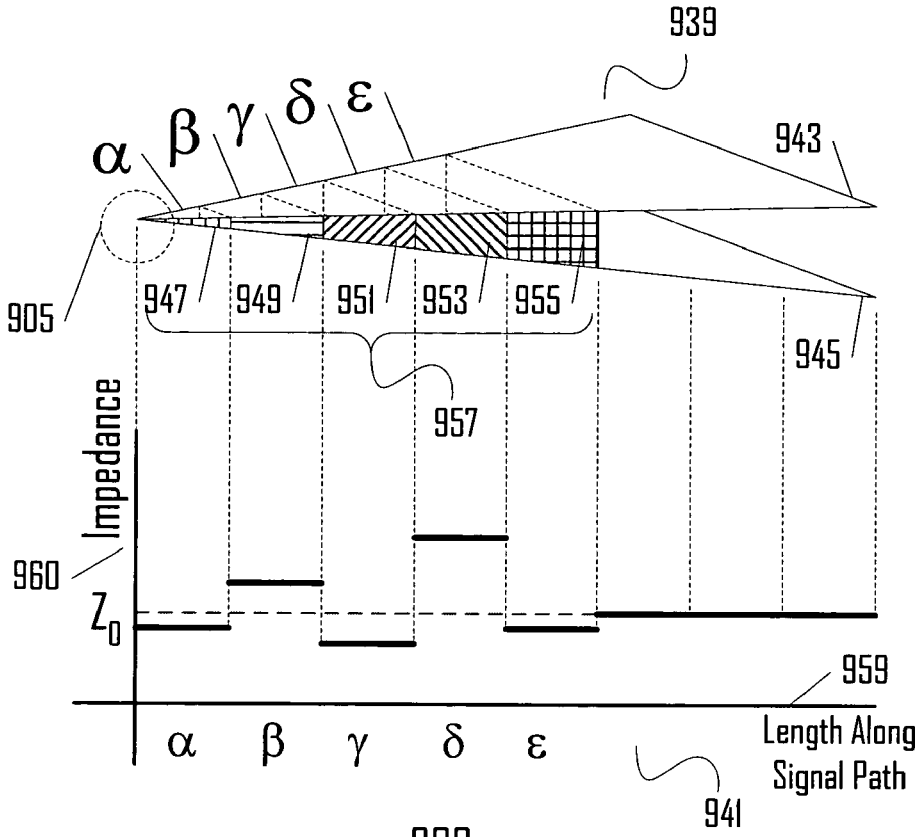
FIG. 9 is a schematic diagram of a first alternate embodiment spectral control antenna and a corresponding impedance profile.

FIG. 9 is a schematic diagram 900 of a first alternate embodiment spectral control antenna, a variable dielectric horn 939 and a corresponding impedance profile 941. Variable dielectric horn 939 comprises a first radiating element 943, a second radiating element 945, and dielectric loading 957. First radiating element 943 and second radiating element 945 cooperate to form a parallel plate waveguide transmission line structure defining a signal path between feed structure 905 and a surrounding medium or space. Dielectric loading 957 comprises a first dielectric section 947 (denoted "α"), a second dielectric section 949 (denoted "β"), a third dielectric section 951 (denoted "γ"), a fourth dielectric section 953 (denoted "δ"), and a fifth dielectric section 955 (denoted "ϵ"). For purpose of illustration and not limitation, dielectric loading 957 comprises five discrete sections with fixed dielectric constant. In alternate embodiments, dielectric loading 957 may include more than five or fewer than five sections. In still further embodiments, dielectric loading 957 may comprise a dielectric material with continuously variable dielectric constant. Dielectric loading 957 results in impedance profile 941. Impedance profile 941 depicts length along horizontal axis 959 and impedance along vertical axis 960. Impedance profile 941 may be tailored to result in a desired antenna transfer function. First alternate embodiment 939 illustrates how variable dielectric loading may be employed for spectral control of an antenna. The geometry variations illustrated in first alternate embodiment 939 may be applied to any antenna structure in which variation in dielectric constant leads to variation in impedance along a signal path.

Figure 10:
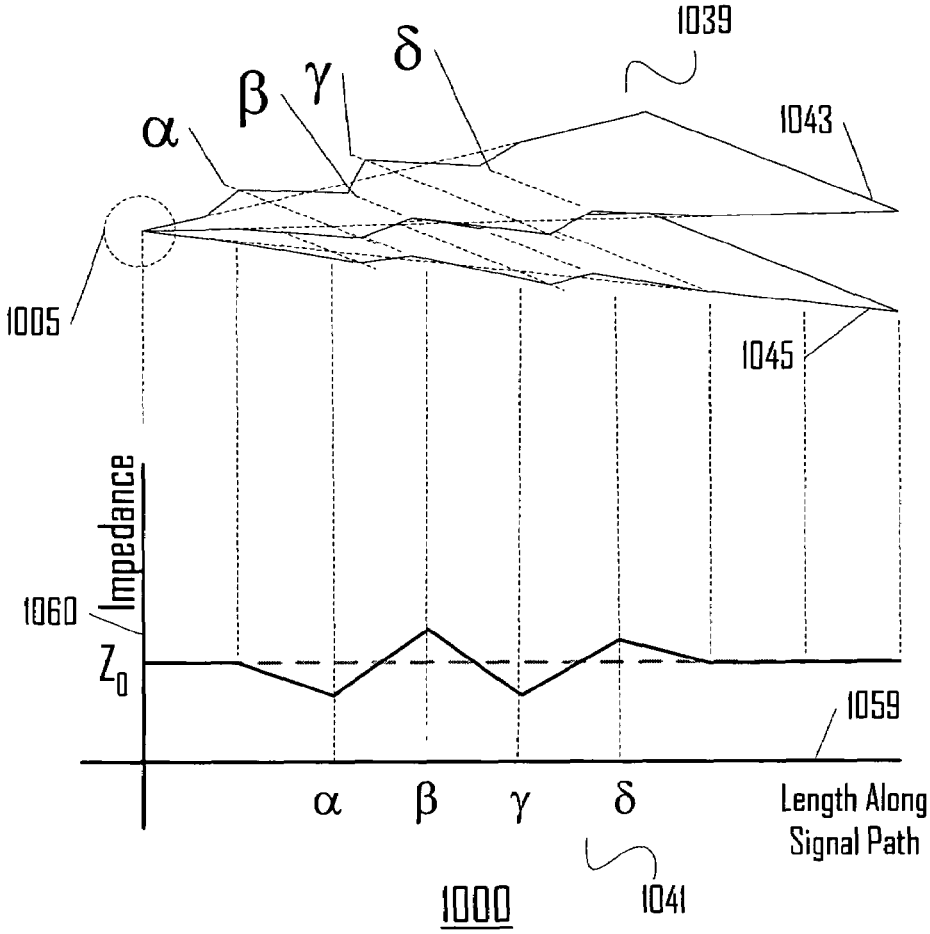
FIG. 10 is a schematic diagram of a second alternate embodiment spectral control antenna and a corresponding impedance profile.

FIG. 10 is a schematic diagram 1000 of a second alternate embodiment spectral control antenna: a variable geometry horn 1039 and a corresponding impedance profile 1041. Variable geometry horn 1039 comprises a first radiating element 1043 and a second radiating element 1045. First radiating element 1043 and second radiating element 1045 cooperate to form a parallel plate waveguide transmission line structure defining a signal path from feed region 1005 to a surrounding space or medium.

Variable geometry horn 1039 becomes wider at a first extremum (denoted "α") resulting in a relatively low impedance. Variable geometry horn 1039 becomes narrower at a second extremum (denoted "β"), resulting in a relatively high impedance. Variable geometry horn 1039 becomes wider at a third extremum (denoted "γ"), resulting in a relatively low impedance. Variable geometry horn 1039 becomes narrower at a fourth extremum (denoted "δ"), resulting in a relatively high impedance.

Variable geometry horn 1039 results in impedance profile 1041. Impedance profile 1041 depicts length along a signal path on horizontal axis 1059 and impedance along vertical axis 1061. Impedance profile 1041 may be tailored to result in a desired antenna transfer function. Second alternate embodiment 1039 illustrates how geometry variation may be employed for spectral control of an antenna. The geometry variation illustrated in second alternate embodiment 1039 may be applied to any antenna structure in which variation in geometry leads to variation in impedance along a signal path.

Figure 11:
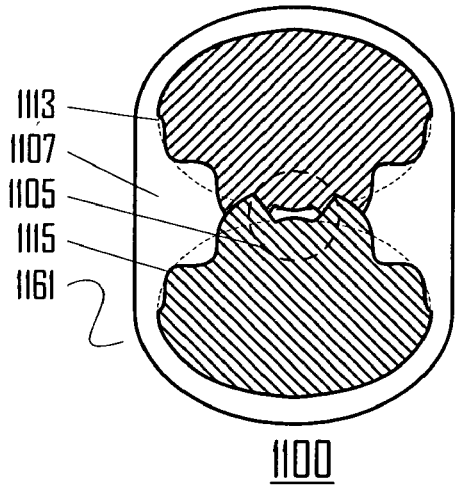
FIG. 11 is a schematic diagram of an elliptical dipole antenna modified according to the teachings of the present invention.

FIG. 11 is a schematic diagram of a planar elliptical dipole antenna modified according to the teachings of the present invention: spectral control elliptical dipole 1163. Spectral control elliptical dipole 1163 comprises a first radiating element 1113 on a front side of a dielectric substrate 1107, a second radiating element 1115 on a back side of dielectric substrate 1107, and a feed region 1105. First radiating element 1113 and second radiating element 1115 cooperate to form complex tapered slot 1117. Complex tapered slot 1117 is yet another example of geometry variations may be employed for spectral control of an antenna. Complex taper slot 1117 is also a transmission line structure defining a signal path.

Spectral control elliptical dipole 1163 is an open slot antenna, because complex taper slot 1117 is an open slot (i.e. an open slot transmission line structure) formed by two conductors (like first conducting surface 1113 and second conducting surface 1115) that are not electrically coupled except at a feed region (like feed region 1105). The teachings of the present invention may be applied to either closed or open slot antenna structures. Other examples of open slot antennas include monopole antennas, and planar horn antennas. Open slots may include either offset or same-side slot line structures.

Figure 12:
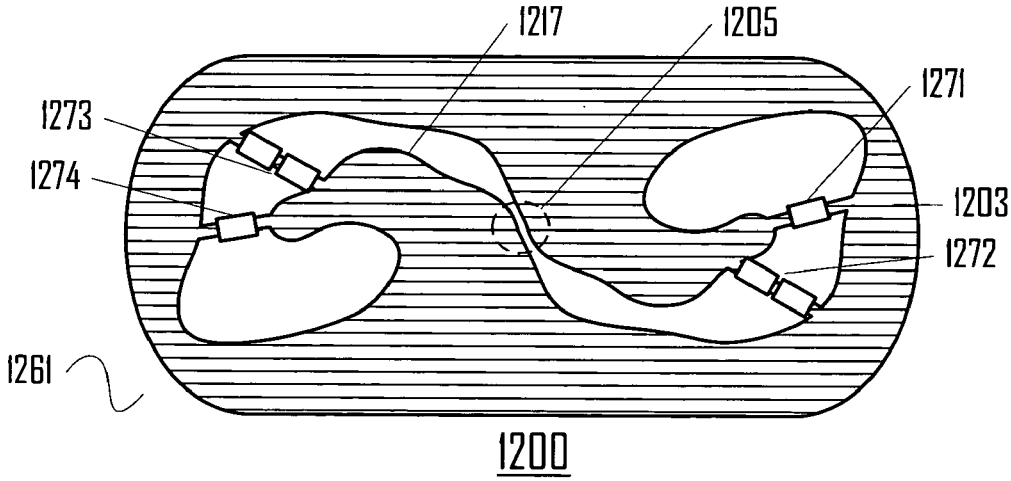
FIG. 12 is a schematic diagram of a spiral slot antenna modified according to the teachings of the present invention.

FIG. 12 is a schematic diagram of a spiral slot antenna modified according to the teachings of the present invention: spectral control spiral slot antenna 1261. Spectral control spiral slot antenna 1261 comprises complex tapered spiral slot 1217 in conducting layer 1203 excited across feed gap 1205. Appropriate selection of a geometry for complex tapered spiral slot 1217 leads to a desired impedance profile and thence to a desired antenna transfer function. Complex tapered spiral slot 1217 is an example of a same side slot line. A same side slot line may be used in conjunction with the present invention, although an offset slot line is preferred for planar antenna implementations.

Complex tapered spiral slot 1217 also employs discrete loading. Discrete loading comprises first lumped element set 1271, second lumped element set 1272, third lumped element set 1273, and fourth lumped element set 1274. A lumped element set may include a single lumped element or more than one lumped element. A plurality of lumped element sets may be employed for discrete loading to give rise to a desired impedance profile and a desired antenna spectral response.

Lumped element sets behave electrically like shunt elements. Thus if a lumped element set is an inductor, it can affect a high pass filter characteristic. In particular, if a lumped element set is an inductor in series with a resistor, low frequency components that might otherwise be reflected without radiating may be dissipated instead of contributing to poor matching behavior. If a lumped element set is a capacitor, it can affect a low pass filter characteristic. If a lumped element set is a resistor it can implement an attenuation. More complicated arrangements of lumped elements can give rise to more sophisticated impedance profiles and desired transfer functions. Discrete loading may be used alone or in any combination with geometry variation or dielectric loading.

The present application has demonstrated application of spectral control techniques to parallel plate antenna structures (such as variable geometry horn 1039), to closed slot type antenna structures (such as spectral control spiral slot antenna 1261), and to open slot or notch type antenna structures (such as spectral control elliptical dipole 1161). In fact, the teachings of the present invention may be applied to any antenna structure in which variation in geometry leads to variation in impedance along a signal path. The teachings of the present invention may also be applied to any antenna structure in which variation in dielectric loading leads to variation in impedance along a signal path. Further, the present application also relates to any antenna structure in which discrete loading is applied along a signal path to create a desired impedance variation.

Offset Overlapping Slotline Feed Region

A 50 ohm impedance is the standard choice among practitioners of the RF arts. Originally chosen as a compromise between coaxial cable efficiency and power handling capability, 50 ohm also provides a reasonable compromise between the 73 ohm impedance of a thin wire dipole, and the 36 ohm impedance of a typical thin whip monopole. Many antennas are designed to have an input impedance around 50 ohms for convenient interfacing to test equipment if for no other reason.

In many cases of practical interest, however, it is useful to have an antenna with a low input impedance. A low input impedance allows a transmit antenna to be driven efficiently even by low voltage, high current drivers. Also a low input impedance can help reduce thermal noise in a receive front-end. Introduction of an offset overlapping slot line structure in a feed region is an excellent way to accomplish these ends. Following are four examples.

Figure 13:
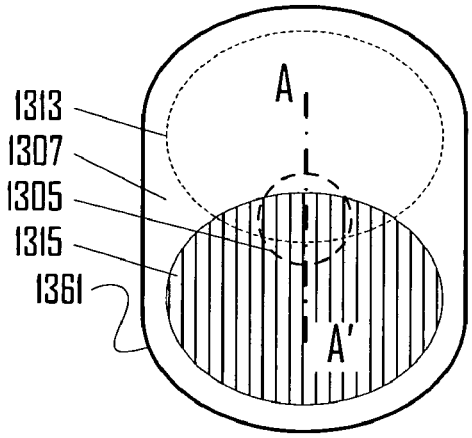
FIG. 13 is a schematic diagram of an offset overlapping slot line dipole antenna apparatus.

FIG. 13 is a schematic diagram 1300 of offset overlapping slot line dipole antenna apparatus 1361. Offset overlapping slot line dipole antenna apparatus 1361 comprises a first radiating element 1313 on a back side of a dielectric substrate 1307, a second radiating element 1315 on a front side of a dielectric substrate 1307, and a feed region 1305. First radiating element 1313 may be thought of as a first metallization on a first side of a dielectric substrate 1307. Second radiating element 1315 may be thought of as a second metallization on a second side of a dielectric substrate 1307. First radiating element 1313, second radiating element 1315, and dielectric substrate 1307 cooperate to form an offset overlapping slot line. Partial section A-A' indicates a location of an offset overlapping antenna slot line as described in FIG. 2.

Alternatively, first radiating element 1313, second radiating element 1315, and dielectric substrate 1307 further cooperate to form offset overlapping slot line dipole antenna apparatus 1361 with feed region 1305.

Figure 14:
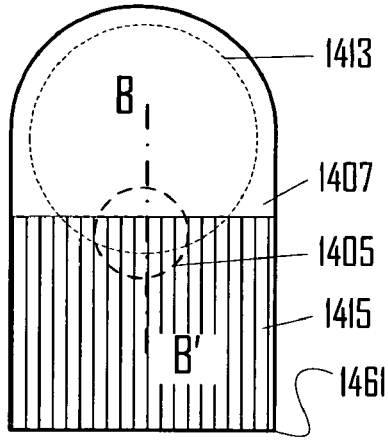
FIG. 14 is a schematic diagram of a offset overlapping slot line monopole antenna apparatus.

FIG. 14 is a schematic diagram 1400 of offset overlapping slot line monopole antenna apparatus 1461. Offset overlapping slot line monopole antenna apparatus 1461 comprises a radiating element 1413 on a back side of a dielectric substrate 1407, a counterpoise 1415 on a front side of a dielectric substrate 1407, and a feed region 1405. Radiating element 1413 may be thought of as a first metallization on a first side of a dielectric substrate 1407. Counterpoise 1415 may be thought of as a second metallization on a second side of a dielectric substrate 1407. Radiating element 1413, counterpoise 1415, and dielectric substrate 1407 cooperate to form an offset overlapping slot line. Partial section B-B' indicates a location of an offset overlapping antenna slot line as described in FIG. 2.

Alternatively, radiating element 1413, counterpoise 1415, and dielectric substrate 1407 further cooperate to form offset overlapping slot line monopole antenna apparatus 1461 with feed region 1405.

Figure 15:
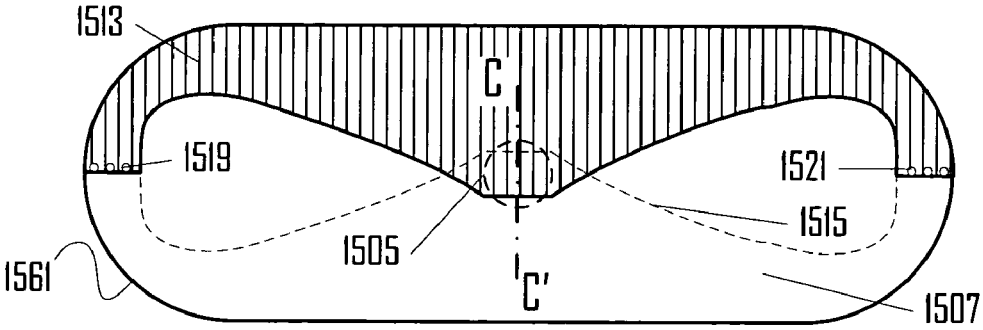
FIG. 15 is a schematic diagram of a offset overlapping slot line magnetic slot antenna apparatus.

FIG. 15 is a schematic diagram 1500 of offset overlapping slot line magnetic slot antenna apparatus 1561. A first conducting surface 1513 on a front side of a dielectric substrate 1507, and a second conducting surface 1515 on a back side of a dielectric substrate 1507, and a feed region 1505. A first plurality of vias 1519 and a second plurality of vias 1521 electrically connect a first conducting surface 1513 to a second conducting surface 1515, thus forming a magnetic slot antenna with feed region 1505. First conducting surface 1513 may be thought of as a first metallization on a first side of a dielectric substrate 1507. Second conducting surface 1515 may be thought of as a second metallization on a second side of a dielectric substrate 1507. First conducting surface 1513, second conducting surface 1515, and dielectric substrate 1507 cooperate to form an offset overlapping slot line. Partial section C-C' indicates a location of an offset overlapping antenna slot line as described in FIG. 2.

Alternatively, a first conducting surface 1513, a second conducting surface 1515, a first plurality of vias 1519, a second plurality of vias 1521, and dielectric substrate 1507 further cooperate to form offset overlapping slot line magnetic slot antenna apparatus 1561 with feed region 1505.

Figure 16:
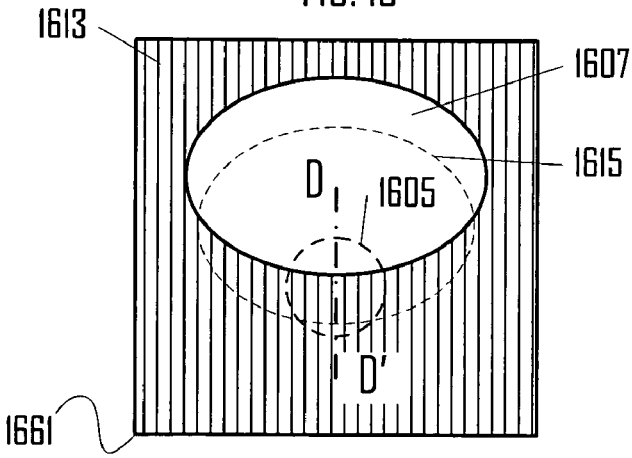
FIG. 16 is a schematic diagram of a offset overlapping slot line annular slot antenna apparatus.

FIG. 16 is a schematic diagram 1600 of offset overlapping slot line annular slot antenna apparatus 1661. Offset overlapping slot line annular slot antenna apparatus 1661 comprises a first metallization 1613 on a front (or first) side of a dielectric substrate 1607, a second (or elliptical shaped) metallization 1615 on a back (or second) side of a dielectric substrate 1607, and a feed region 1605. A first metallization 1613, a second metallization 1615, and a dielectric substrate 1607 cooperate to form an offset overlapping slot line. Partial section D-D' indicates a location of an offset overlapping antenna slot line as described in FIG. 2.

Alternatively, a first metallization 1613, a second metallization 1615, and dielectric substrate 1607 further cooperate to form offset overlapping slot line annular slot antenna apparatus 1661 with feed region 1605.

Specific applications have been presented solely for purposes of illustration to aid the reader in understanding a few of the great many contexts in which the present invention will prove useful. It should also be understood that, while the detailed drawings and specific examples given describe preferred embodiments of the invention, they are for purposes of illustration only, that the system and method of the present invention are not limited to the precise details and conditions disclosed and that various changes may be made therein without departing from the spirit of the invention which is defined by the following claims:

I claim:

1. An offset overlapping slot line antenna apparatus comprising:

a first conducting region lying in a first plane;

a second conducting region lying in a second plane;

said first plane and said second plane being parallel, but not coplanar;

said first conducting region having a non-overlapping portion relative to said second conducting region as viewed perpendicular to first plane;

said second conducting region having a non-overlapping portion relative to said first conducting region as viewed perpendicular to said first plane;

said first conducting region having a first slot edge proximal to said second conducting region;

said second conducting region having a second slot edge proximal to said first conducting region;

said second slot edge spaced from said first slot edge;

said first slot edge and said second slot edge forming a slot transmission line between said first conducting region and said second conducting region;

said slot transmission line having a characteristic impedance as a function of a distance from said feed region along said slot transmission line;

said slot transmission line including at least one section wherein said first conducting region and said second conducting region are non-overlapping;

said slot transmission line fed by coupling across said first conducting region and said second conducting region at a feed region and establishing two signal paths from said feed region along said slot transmission line to surrounding free space; said two signal paths being in opposite directions from said feed region;

said slot transmission line overlapping in said feed region, yielding an extremum in impedance at said feed region along each of said two signal paths.

2. The antenna of claim 1, wherein said slot transmission line is an open slot transmission line, said open slot transmission line characterized by being open at an end distant from said feed region.

3. The antenna of claim 2, wherein said first conducting region and said second conducting region cooperate to form a dipole antenna, said dipole antenna characterized by said first conducting region and said second conducting region being of the same size and offset from one another, said first conducting region and said second conducting region overlapping at said feed region.

4. The antenna of claim 2, wherein said first conducting region and said second conducting region cooperate to form a monopole antenna, said monopole antenna characterized by said second conducting region being larger than said first conducting region, said first conducting region and said second conducting region overlapping at said feed region.

5. The antenna of claim 3, wherein the first conducting region is an ellipse.

6. The antenna of claim 1, wherein said slot transmission line is a closed slot transmission line, said closed slot transmission line characterized by said first conducting region and said second conducting region including electrical coupling at an end distant from said feed region.

7. The antenna of claim 6, wherein said electrical coupling comprises an electrical connection or capacitive coupling between said first conducting region and said second conducting region.

8. The antenna of claim 6, wherein the first conducting region and second conducting region cooperate to form a magnetic slot antenna, said magnetic slot antenna characterized by said slot transmission line surrounded by a conductive surface comprising said first conductive region and said second conductive region.

9. The antenna of claim 1, wherein the first conductive layer, second conductive layer, and substrate layer cooperate to form an annular slot antenna, said annular slot antenna characterized by said second conductive layer having a larger outer dimension than said first conductive layer; said second conductive layer having a hole corresponding in shape to said first conductive layer; said first conductive layer offset from said hole in said second conductive layer sufficiently to overlap said second conductive layer at the feed region.

10. The antenna of claim 9, wherein the first conductive layer is elliptical.

11. An offset overlapping slot line antenna apparatus comprising:

an insulating substrate layer, a first conducting region on a first side of said substrate layer; and a second conducting region on a second side of said substrate layer;

said first conducting region having a non-overlapping portion relative to said second conducting region as viewed perpendicular to said substrate layer;

said second conducting region having a non-overlapping portion relative to said first conducting region as viewed perpendicular to said substrate layer;

said first conducting region having a first slot edge proximal to said second conducting region;

said second conducting region having a second slot edge proximal to said first conducting region;

said second slot edge spaced from said first slot edge;

said first slot edge and said second slot edge forming a slot transmission line between said first conducting region and said second conducting region;

said slot transmission line including at least one section wherein said first conducting region and said second conducting region are non-overlapping;

said slot transmission line fed by coupling across said first conducting region and said second conducting region at a feed region and establishing two signal paths from said feed region along said slot transmission line to surrounding free space; said two signal paths being in opposite directions from said feed region;

said slot transmission line overlapping in said feed region, yielding an extremum in impedance at said feed region along each of said two signal paths.

12. The antenna of claim 11, wherein said slot transmission line is an open slot transmission line, said open slot transmission line characterized by being open at an end distant from said feed region.

13. The antenna of claim 12, wherein said first conducting region and said second conducting region cooperate to form a dipole antenna, said dipole antenna characterized by said first conducting region and said second conducting region being of the same size and offset from one another, said first conducting region and said second conducting region overlapping at said feed region.

14. The antenna of claim 12, wherein said first conducting region and said second conducting region cooperate to form a monopole antenna, said monopole antenna characterized by said second conducting region being larger than said first conducting region, said first conducting region and said second conducting region overlapping at said feed region.

15. The antenna of claim 13, wherein the first conducting region is an ellipse.

16. The antenna of claim 11, wherein said slot transmission line is a closed slot transmission line, said closed slot transmission line characterized by said first conducting region and said second conducting region including electrical coupling at an end distant from said feed region.

17. The antenna of claim 16, wherein said electrical coupling comprises an electrical connection or capacitive coupling between said first conducting region and said second conducting region.

18. The antenna of claim 16, wherein the first conducting region and second conducting region cooperate to form a magnetic slot antenna, said magnetic slot antenna characterized by said slot transmission line surrounded by a conductive surface comprising said first conductive region and said second conductive region.

19. The antenna of claim 11, wherein the first conductive layer, second conductive layer, and substrate layer cooperate to form an annular slot antenna, said annular slot antenna characterized by said second conductive layer having a larger outer dimension than said first conductive layer; said second conductive layer having a hole corresponding in shape to said first conductive layer; said first conductive layer offset from said hole in said second conductive layer sufficiently to overlap said second conductive layer at the feed region.

20. The antenna of claim 11, wherein the first conductive layer is elliptical.

* * * * *